United States Patent [19]

Hirsch

[11] Patent Number: 4,856,926

[45] Date of Patent: Aug. 15, 1989

[54] SHEET BINDER

[76] Inventor: Karl Hirsch, Linsenberg 26, A-9064 Pischeldorf (Karnten), Austria

[21] Appl. No.: 243,708

[22] Filed: Sep. 13, 1988

[30] Foreign Application Priority Data

Sep. 16, 1987 [AT] Austria ..... 2340/87

[51] Int. Cl.[4] ..... B42F 3/00; B42F 13/12

[52] U.S. Cl. ..... 402/13; 402/68

[58] Field of Search ..... 402/9, 13, 68, 80 R

[56] References Cited

U.S. PATENT DOCUMENTS

| | | | |
|---|---|---|---|
| 2,324,004 | 7/1943 | Kriegsman | 402/68 X |
| 2,523,922 | 9/1950 | Neuschwander | 402/68 X |
| 2,536,792 | 1/1951 | Wendt | 402/68 X |
| 3,834,824 | 9/1974 | Jahn | 402/13 |
| 4,437,781 | 3/1984 | Weihe et al. | 402/13 X |
| 4,784,507 | 11/1988 | Vetter | 402/13 |

FOREIGN PATENT DOCUMENTS

| | | |
|---|---|---|
| 280944 | 4/1970 | Austria . |
| 0142489 | 5/1985 | European Pat. Off. . |

*Primary Examiner*—Paul A. Bell

*Attorney, Agent, or Firm*—Young & Thompson

[57] ABSTRACT

In a sheet binder (1), which consists of a rear cover (2) and a front cover (3) connected with each other by means of a folded spline strip (4), in the area between the rear cover (2) and the front cover (3), a strap (10) is provided in the area of the fold (5), this strap being connected with the binder (1). Prongs (13, 14) extending essentially parallel to the fold (5) are punched from the rear cover (2). The prongs (13, 14) are inserted for the binding of the sheets (15) into holes (16) provided in the strap (10) and then passed with their free ends downward through further holes (17) provided spaced apart from the holes (16) in the strap (10). To simplify the insertion of the prongs (13, 14) in the strap (10), the holes (16) have open through connections (16') toward the free end of the strap (10).

22 Claims, 5 Drawing Sheets

SHEET BINDER

Figure 1:
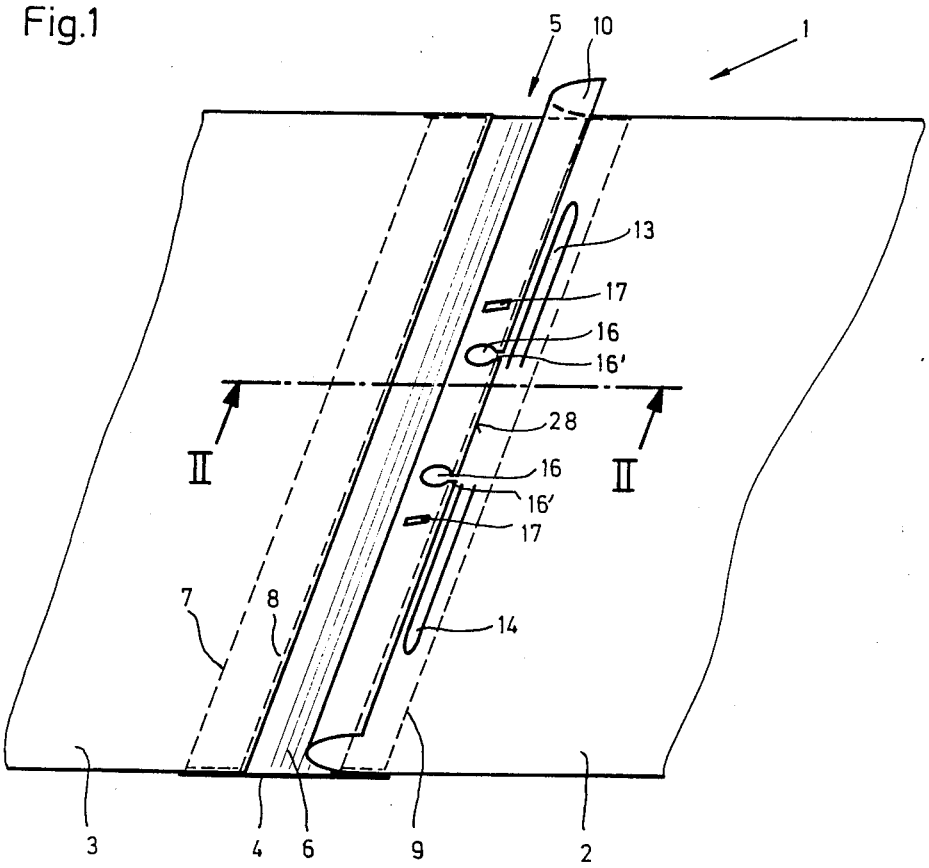

The invention concerns a sheet binder consisting of a rear and a front cover connected with each other by means of a folded spine strip, wherein the rear cover preferably is made of a sheet plastic more rigid than the front cover, and wherein the strip connecting the front cover with the rear cover consists of a flexible material, for example a flexible plastic sheet.

Binders of this type are known from AT-B-280 944 and EP-A-0 142 489.

In the known sheet binders the binding mechanism consists of a rapid binding prong in the form of a metal strip, which is joined to the rear cover of the binder in that the rapid binding prong is inserted through holes in the rear cover of the binder. In the case of the known binders a cover strip is further provided, said cover strip comprising two holes through which the bent up ends of the rapid binding prong may be inserted prior to being bent over to fasten the written material or the like.

The known binders thus consist of several components, so that their manufacture is costly. Furthermore, there is the risk that the cover strip may be lost, in which case the sheet material is secured poorly in the binder.

It is the object of the invention to provide a binder of the aforementioned generic type, without the aforedescribed disadvantages.

This object is attained according to the invention in that between the rear cover and the front cover in the area of the spine fold a strap extending over the entire height of the binder is provided, that a plurality of prongs prepunched onto or punched from the rear cover is provided in the area of the spine fold, that a hole is provided in the strap at the location of each prong whereby said strap is connected with the rear cover of the binder or the strip, and that spaced apart from said hole another hole is provided in the strap.

By means of the fact that the prongs serving as rapidly binding prong fasteners are punched from the rear cover of the binder or are prepared for separation by prepunching, the fastening of the prong to the binder required in the known binders, is eliminated. As according to the invention a strap connected with the binder is provided as the cover strip, the latter is always aligned correctly relative to the prongs and cannot be lost. The strap provided according to the invention and serving as the cover strip has the further advantage that it covers the document material bound in the binder in the area of the edge of the binder over its entire length, so that the corners of the sheets cannot bend over in particular during the closing of the binder to form the so-called "dog's ears".

The holes which are laterally open in one form of embodiment of the invention, make it easier to thread the prongs into the holes than with the holes closed.

For the binding of sheets or the like, punched with two holes according to the invention two prongs and in the strap two pairs of holes, may be provided.

When sheets with three holes (American punching) are to be inserted, three prongs and three pairs of holes in the straps are provided advantageously in the strap.

One form of embodiment of the invention, wherein sheets with two or four holes may be inserted, is characterized in that four prongs and in the strap four pairs of holes are provided.

The manufacture of the binder according to the invention is particularly simple as the latch is made in one piece with the rear cover of the binder, as in this form of embodiment it is not necessary to connect the latch separately with the binder in the area of the spline strip.

It is provided advantageously by the invention that the prongs are located in the area of the rear cover that is covered by the strip connecting the rear with the front cover. This form of embodiment has the advantage that the rapid binding prongs and the openings formed after the upward bending in the rear cover of the binder are not visible from the outside.

The hold of the rapid binder prongs, which are inserted upward through one hole of the associated pair of holes and then downward through the adjacent hole of the pair of holes, is improved, if in the areas in which the prongs are connected with the rear cover of the binder opposing holes in he latch are round and the holes adjacent to them are in the form of slits extending transversely to the fold of the binder.

As the rear cover of binders usually consists of a more rigid plastic sheet, it is advisable within the invention to provide in the area of transition between the rear cover and the strap, an area rendered more flexible for example by means of grooving. This form of embodiment has the advantage that the upward bending of the latch required in the binding of sheet material in the binder according to the invention may be carried out without difficulty and that said latch does not break even during extended use.

To align the prongs over an adequate length, whereby not only a larger stack of sheets or the like may be bound, but the insertion of the prongs through the pairs of holes is also simplified, said prongs may be arranged in a mutually and laterally overlapping manner. In this fashion, the prongs may be given the length desired, even in the case of smaller formats of the binder.

It is preferred according to the invention that the connections of the holes which in the areas of the prongs in which the latter are joined to the rear cover of the binder or the strip, are opposing each other, be narrower as measured with the free longitudinal edge of the strap, than the holes themselves.

Figure 2:
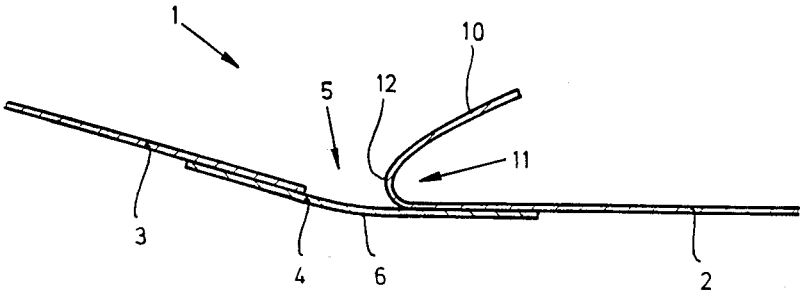
Figure 3:
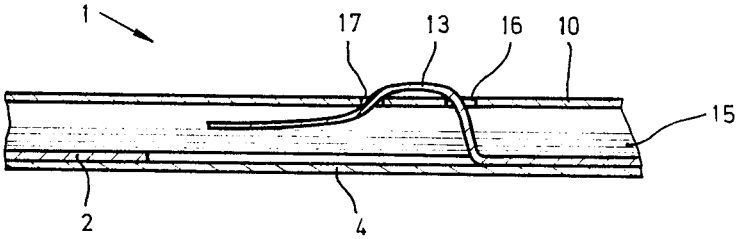
Figure 4:
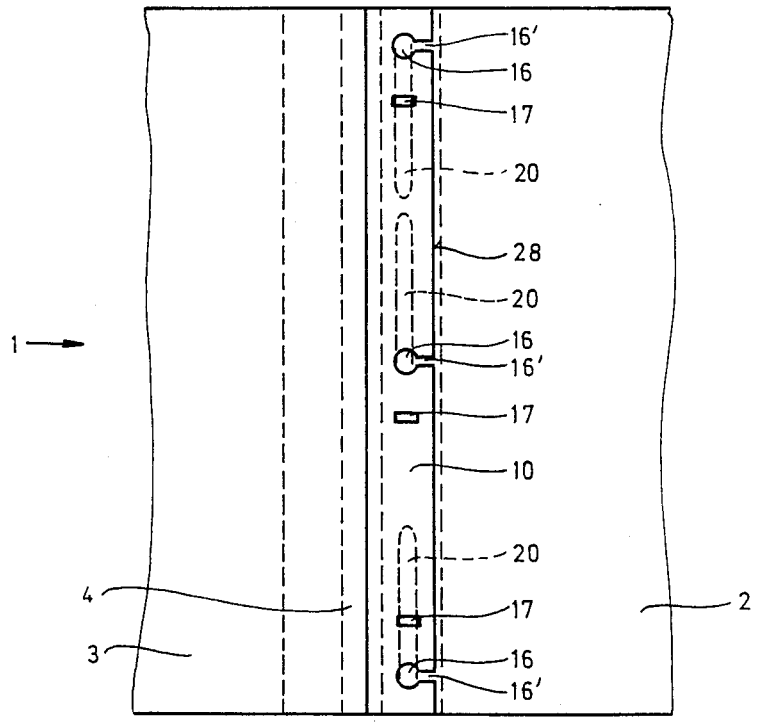
Figure 5:
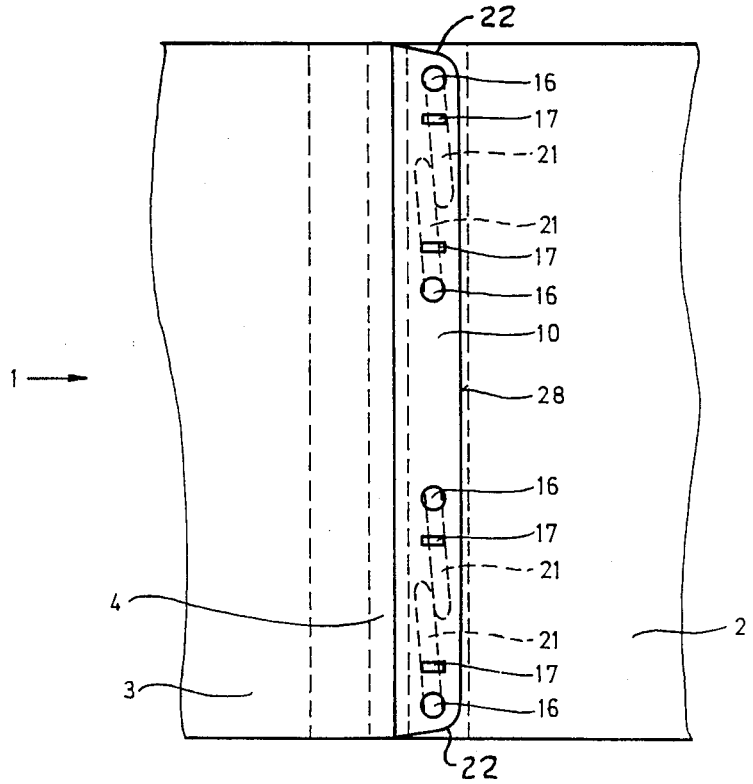
Figure 6:
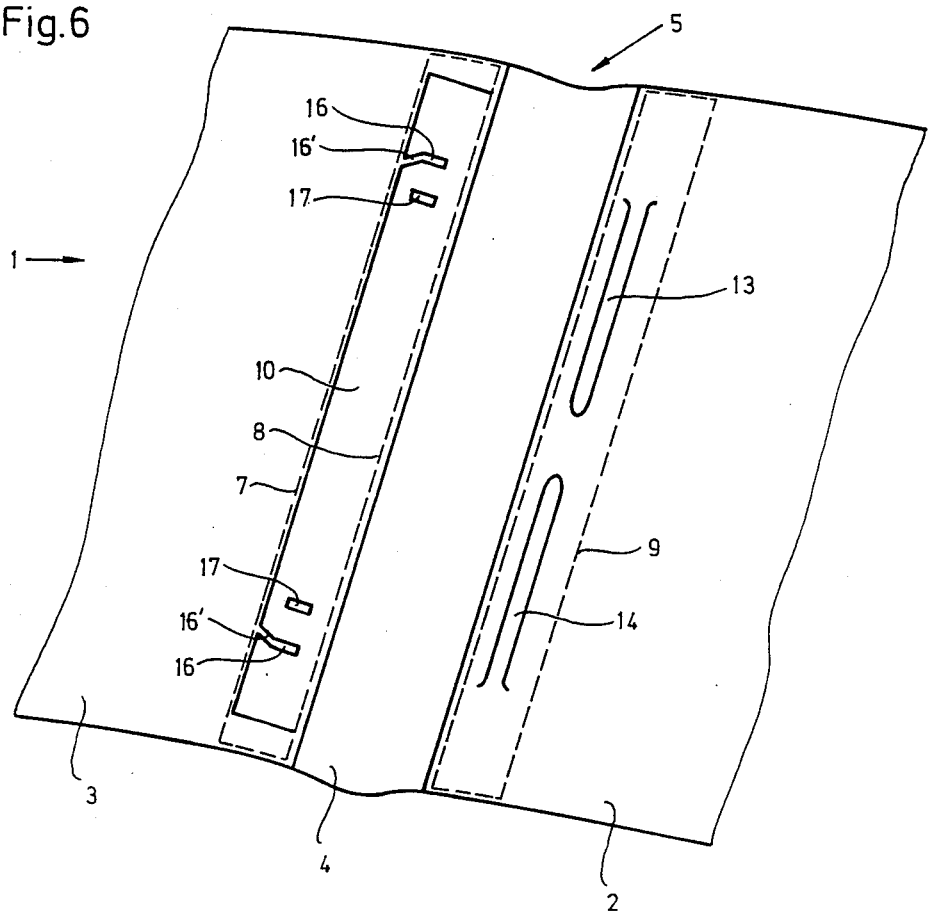
Figure 7:
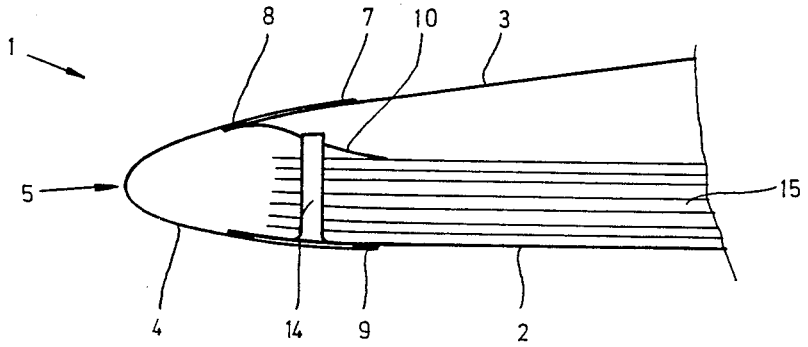
Figure 8:
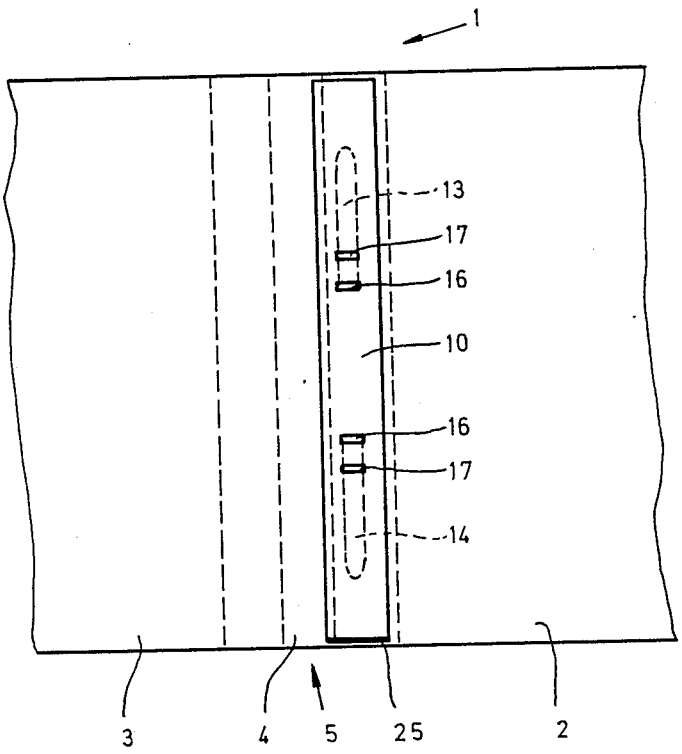
Figure 9:
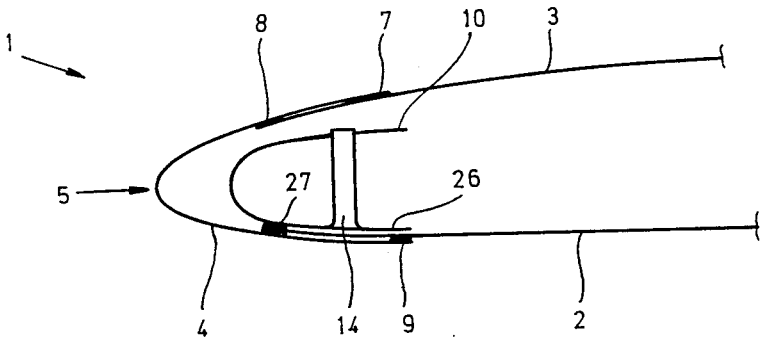
Figure 10:
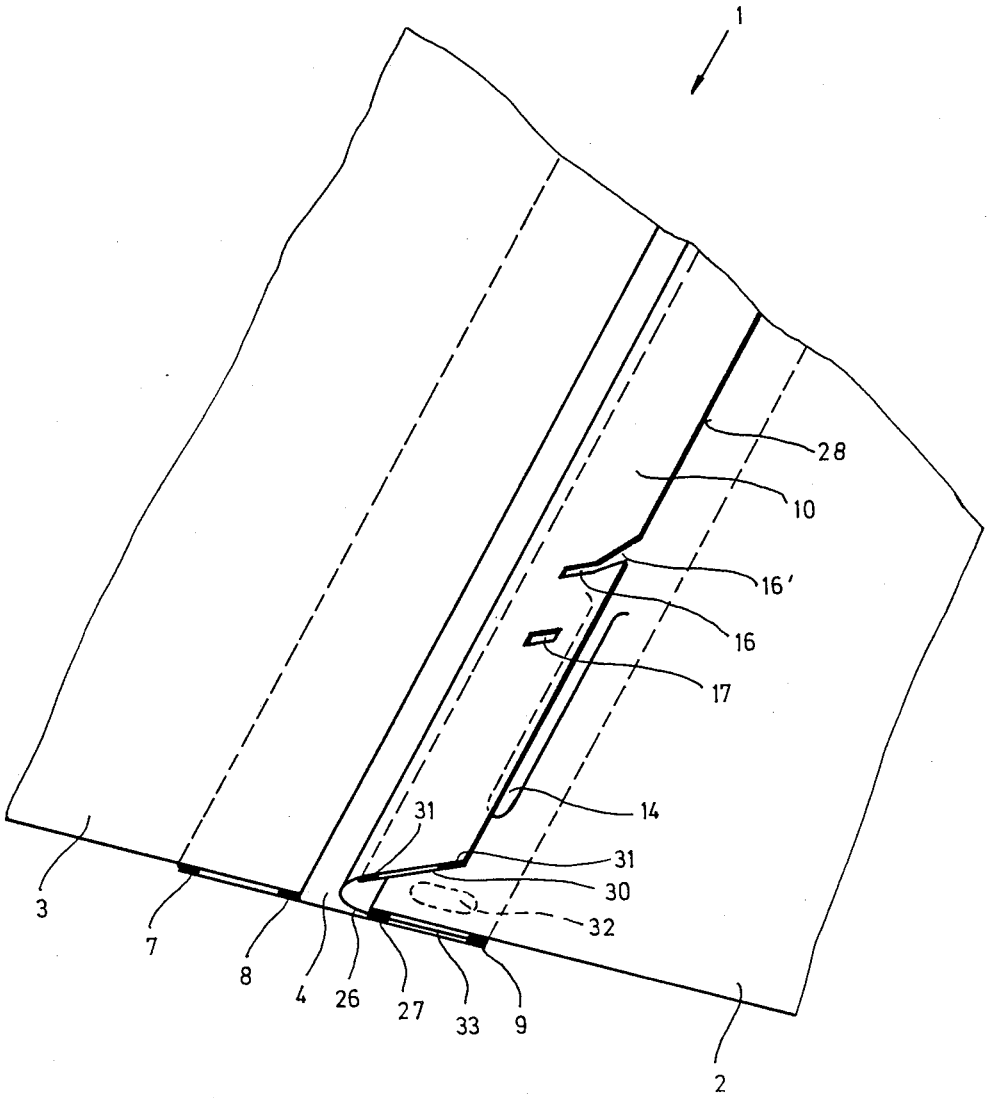

Further details and characteristics will become apparent from the description below of the examples of embodiment of binders shown schematically in the drawings. In the drawings:

FIG. 1 shows a partial view of a binder with two prongs in an oblique view,

FIG. 2 a longitudinal section on the line II—II in FIG. 1,

FIG. 3 a detail of the binder of FIG. 1 with a rapid binding prong in its use position, FIG. 4 partially a form of embodiment with three prongs, FIG. 5 partially a form of embodiment of a binder with four prongs, FIG. 6 partially a binder in the form of a ledger sheet binder and FIG. 7 the binder of FIG. 6 in the closed state, FIG. 8 a partial view of a further form of embodiment, FIG. 9 a section through another form of embodiment and FIG. 10 an oblique view (partial) of another form of embodiment.

A binder shown in FIG. 1 consists of a rear cover 2 and a front cover 3, together with a spine strip 4 connecting the rear cover with the front cover 3.

The rear and the front covers consist of plastic sheets, with the plastic of the rear cover usually being more rigid than that of the front cover 3.

The spine strip 4 consists of a soft sheet plastic and may be provided in the area of the backing fold 5 with grooves 6, to facilitate the bending of the spline strip 5 during the opening and closing of the binder 1.

If, as in the example of embodiment shown the rear cover 2, the front cover 3 and the spine strip 4 consist of plastic sheets, the parts of the binder 1 may be joined together by means of welds, indicated in FIG. 1 ny the broken lines 7, 8 and 9.

As seen in FIG. 1, a strap 10 is provided, extending in the area of the fold 5 over the entire height of the binder, said strap being in one piece with the rear cover 2 in the example of embodiment shown and rendered flexible in its bending range 11 by means of a plurality of grooves 12.

From the rear cover 2 of the binder 1, in the example of embodiment shown in FIG. 1, two rapid binding prongs 13 and 14 are punched out trilaterally, so that they may be bent upwards from the plane of the rear cover 2.

To secure the written material 15 or the like, the strap 10 is folded upwards and the material 15 inserted with the binder holes provided therein over the prongs 13 and 14, which are also bent upwards. Subsequently, the prongs 13 are inserted upwards through the holes 16 in the strap 10 and then inserted downwards through the preferably slit like holes 17 adjacent to said holes 16, so that their free ends are located between the sheets 15 and the strap 10, as shown in FIG. 3.

FIG. 4 shows a form of embodiment of a binder 1 according to the invention, in which three rapid binding prongs 20 are punched altogether from the rear cover 2. Correspondingly, three pairs of holes, consisting of round holes 16 and slit like holes 17, are provided in the strap.

In the form shown in FIG. 5 of a binder 1 according to the invention, a total of four prongs 21 is punched out from the rear cover 2 of the binder 1, and accordingly altogether four pairs of holes, consisting of round holes 16 and slits 17, are provided in the strap 10, which as shown in FIG. 5, may also have rounded corners 22.

It is further shown in FIG. 5 that the prongs 21 are punched from the rear cover 2 in a laterally overlapping manner, so that they may be longer than the distance of their ends connected with the cover 2 from each other.

Although not shown in the drawings, other forms of embodiment with different layouts of prongs and a correspondingly different arrangement of the pairs of holes in the strap 10, are conceivable, so that sheet with two, three or four holes may be inserted in the same binder, as needed. In particular, in this example of embodiment of the binder 1 according to the invention, it may be provided that the prongs are not punched out free from the rear cover 2, so that only the prongs actually needed are freed from the cover.

The binder 1 according to the invention may be designed for the insertion of sheets of arbitrary size, thus for example the format of DIN (German Industrial Standard) A4. It is also possible to design the binder 1 for the collection of ledger sheets, for which they are made correspondingly smaller (for example 20×11 cm). A binder 1 intended for ledger sheets is opened, in contrast to binders containing prospectuses or the like, practically only for the insertion of another ledger sheet. Prospectus binders, on the other hand, are (and should be) perused frequently. It is sufficient therefore in the case of binders 1 for ledger sheets ("ledger sheet binders") that the binder mechanism hold the ledger sheets with the binder closed, while the automatic release of he strap performing the function of the cover strip when the binder 1 is completely opened, is of advantage.

A ledger sheet binder of this type is shown in FIG. 6 and 7. In this binder the strap 10 is provided from the front cover 3 in the area covered by the backing strip 4 of the latter, i.e. between the weld beads 7 and 8. With the binder closed (FIG. 7), the prongs 13, 14 are inserted through the holes 16 and 17 in the strap 10, both of which are in the form of slits, so that the sheets 15 (ledger sheets) are held securely. When the front cover 3 is folded during the opening of the binder 1 into the position shown in FIG. 6, the strap 10 is pulled from the prongs 13, 14 and another ledger sheet may be inserted. In this case the connections 16' are as wide as the holes 16 themselves. It is also possible to have the connections 16' broadening toward the free edge 28 of the strap 10. In the case of holes 16 in the form of slits the connections 16' again may be narrower at least at their ends on the side of the hole than the hole 16 itself.

The form of embodiment shown in FIG. 6 and 7 is obviously not restricted to ledger sheet binders, but is of advantage any time written documents are assembled. In the form of embodiment shown in FIG. 8 the strap 10 is connected in the area of one of its ends with the rear cover 2 and the strip 4, respectively, by means of a weld bead 25.

FIG. 9 shows that the prongs 13 and 14 may also be punched out of a strip 26 joined to the rear cover 2 by means of a longitudinal weld 27. In the binder of FIG. 9 the latch 10 is furthermore in a single piece with the strip 26.

The binder 1 partially shown in FIG. 10 comprises a rear cover 2 and a front cover 3, connected with each other by a spline strip 4. In the overlapping area of the strip 4 and the rear cover 2, one leg of the strip 26 is located and secured by the welds 9 and 27. The other leg of the strip 26 forms the strap 10. The strap 10 is reinforced by a support 30, with the holes 16 and 17 being present in both the strap 10 and the support 30. The support 30 is connected with the strap 10 by means of welds 31.

The prongs 14 are punched out of the area of the rear cover covered by the strip 4. The introduction of the prongs 14 into the holes 16 is particularly simple, as the connecting areas 16' are not only broadening toward the free edge 28 of the strap 10, but are also including an acute angle with the latter.

Openings 32 are further punched into the spline strip 4, through which—following the separation of the sheet parts—a hanging rod may be inserted in the space between the strip 4 and a leg 33 of the strip 26.

What is claimed is:

1. Sheet binder (1) consisting of a rear cover (2) and a front cover (3) connected with each other by means of a spline strip (4), wherein the spline strip (4) connecting the front cover (3) with the rear cover (2) consists of a flexible material, characterized in that between the rear cover (2) and the front cover (3) in the area of the fold (5) a strap (10) extending over substantially the entire height of the binder (1) and connected with the binder (1) is provided, that a plurality of prongs (13, 14, 20, 21) are provided, said prongs being punched from the rear cover (2) in the area of the fold (5) or from a strip (26) connected with the binder, that in the strap (10) in the area of each of the prongs (13, 14, 20, 21) in which said prong is connected with the rear cover (2) of the binder or the strip (26), a hole (16) is provided and that spaced apart from said hole (16), another hole (17) is provided in the strap (10).

2. Sheet binder according to claim 1, characterized in that the hole (16) is open toward one of the longitudinal edges of the strap (10).

3. Sheet binder according to claim 1, characterized in that two prongs (13, 14) and in the strap (10) two pairs of holes (16, 17) are provided.

4. Sheet binder according to claim 1, characterized in that three prongs (20) and in the strap (10), three pairs of holes (16, 17) are provided.

5. Sheet binder according to claim 1, characterized in that four prongs (21) and in the strap (10), four pairs of holes (16, 17), are provided.

6. Sheet binder according to claim 1, characterized in that the prongs (13, 14, 20, 21) are provided in the area of the rear cover (2) that is covered by the strip (4) connecting the rear cover (2) with the front cover (2).

7. Sheet binder according to claim 1, characterized in that the holes (16) in the strap (10) located opposite the areas wherein the prongs (13, 14, 20, 21) are connected with the rear cover (2) of the binder (1) are round holes and the holes (17) adjacent to said areas are in the form of slits extending transversely to the fold (5) of the binder (1).

8. Sheet binder according to claim 1, characterized in that the prongs (21) are laterally overlapping within their respective areas.

9. Sheet binder according to claim 1, characterized in that the strap (10) is connected at least at one of its ends (25) with the rear cover of the binder.

10. Sheet binder according to claim 1, characterized in that the strap (10) is in a single piece with the rear cover (2) of the binder (1).

11. Sheet binder according to claim 10, characterized in that in the transition area between the rear cover (2) and the strap (10) an area rendered flexible by grooves (12) is provided.

12. Sheet binder according to claim 1, characterized in that the strap (10) is in a single piece with the front cover (3) of the binder.

13. Sheet binder according to claim 12, characterized in that the strap (10) is located in the cover (3) in its area covered by the strip (4).

14. Sheet binder according to claim 12, characterized in that the strap (10) is connected with the front cover (3) in its area adjacent to the fold (5).

15. Sheet binder according to claim 1, characterized in that two holes (16, 17) of each pair of holes are located in the strap (10) in the form of slits (17) aligned transversely to the fold (5).

16. Sheet binder according to claim 1, characterized in that the prongs (13, 14, 20, 21) are broadening in their areas passing into the rear cover (2) or the strip (26).

17. Sheet binder according to claim 1, characterized in that the connections (16') of the holes (16) located opposite the areas of the prongs (13, 14, 20, 21) wherein said prongs are connected with the rear cover (2) of the binder or the strip (26), are narrower as measured on the free longitudinal edge (28) of the strap (10) in the longitudinal direction of the strap (10), than the holes (16) themselves.

18. Shet binder according to claim 1, characterized in that the strap (10) and the strip (26) are of a single piece, folded in the longitudinal direction and connected in the area of its longitudinal fold with the rear cover (2) of the binder (1).

19. Sheet binder according to claim 1, characterized in that the connection (16') between the hole (16) and the free longitudinal edge (28) of the strap (10) is as wide as the hole (16).

20. Sheet binder according to claim 19, characterized in that the connection (16') is bent.

21. Sheet binder according to claim 20, characterized in that the connection (16') broadens toward the free longitudinal edge (28) of the strap (10).

22. Sheet binder according to claim 1, characterized in that a connection (16') between the hole (16) and the free longitudinal edge (28) of the strap (10) makes an acute angle with the free longitudinal edge (28).

* * * * *